US008142076B2

(12) United States Patent
Shaw

(10) Patent No.: US 8,142,076 B2
(45) Date of Patent: Mar. 27, 2012

(54) TAMPER EVIDENT RETAINING DEVICE FOR USE WITH FLUID IMPREGNATED CLOTHING AND FABRICS

(76) Inventor: Raymond R. Shaw, Farmington Hills, MI (US)

( * ) Notice: Subject to any disclaimer, the term of this patent is extended or adjusted under 35 U.S.C. 154(b) by 427 days.

(21) Appl. No.: 12/417,253

(22) Filed: Apr. 2, 2009

(65) Prior Publication Data

US 2009/0196532 A1 Aug. 6, 2009

Related U.S. Application Data

(63) Continuation-in-part of application No. 11/294,827, filed on Dec. 6, 2005, now abandoned, which is a continuation-in-part of application No. 10/891,347, filed on Jul. 14, 2004, now abandoned, application No. 12/417,253, which is a continuation-in-part of application No. 12/023,792, filed on Jan. 31, 2008, which is a continuation-in-part of application No. 10/891,347, filed on Jul. 14, 2004, now abandoned.

(51) Int. Cl.

| | |
|---|---|
| ***B65D 33/00*** | (2006.01) |
| ***B65D 33/08*** | (2006.01) |
| ***B65D 33/18*** | (2006.01) |
| ***B65D 33/16*** | (2006.01) |
| ***B65D 33/01*** | (2006.01) |

(52) U.S. Cl. ..... 383/5; 383/10; 383/102; 383/205; 383/211

(58) Field of Classification Search ..... 383/5, 10, 383/102, 105, 211, 29, 30, 16, 22; 229/80, 229/76, 79, 80.5, 92, 92.1, 92.3, 87.04, 87.15–87.17, 229/87.01; 206/477, 478, 480; 281/45
See application file for complete search history.

(56) References Cited

U.S. PATENT DOCUMENTS

| | | | | |
|---|---|---|---|---|
| 376,005 | A * | 1/1888 | Manahan | 206/287 |
| 526,799 | A * | 10/1894 | Barnard | 229/75 |
| 1,955,310 | A | 4/1934 | Powell et al. | |
| 1,987,751 | A * | 1/1935 | Sahm | 229/87.04 |
| 2,175,387 | A * | 10/1939 | Goding | 206/280 |
| 2,385,576 | A * | 9/1945 | Leopold | 229/77 |
| 2,437,072 | A | 3/1948 | Campbell | |
| 2,810,510 | A | 10/1957 | Korn | |
| 3,087,669 | A | 4/1963 | Russell | |
| 3,142,436 | A | 7/1964 | Heigl | |
| 3,203,621 | A | 8/1965 | Wright | |
| 3,255,871 | A | 6/1966 | Butler | |
| 3,309,008 | A | 3/1967 | Huck | |
| 3,706,410 | A | 12/1972 | Baker | |

(Continued)

*Primary Examiner* — Nathan J Newhouse
*Assistant Examiner* — Christopher Demeree
(74) *Attorney, Agent, or Firm* — Gifford, Krass, Sprinkle, Anderson & Citkowski, P.C.

(57) ABSTRACT

A tamper-evident retaining device for use with articles of evidence having a base sheet and a secondary sheet connected along conjoined bottoms. A top closure includes a central panel secured along a top of the base sheet, first and second side panels extending from opposite edges of the central panel and pivotally opened in a first position. First and second side flaps extend from the sides of the base sheet such that, upon pre-placement of the evidence article upon the base sheet and subsequent folding up of the secondary sheet to overlay the base sheet, the flaps are inwardly folded to secure, in tamper evident fashion, said sides of said of said secondary sheet to said sides of said base sheet. The side panels are then pivoted inwardly and in overlaying fashion against the central panel in a second position to secure, in tamper evident fashion, the top of the base and secondary sheets.

14 Claims, 7 Drawing Sheets

U.S. PATENT DOCUMENTS 3,865,304 A * 2/1975 Mojonnier et al. ..... 383/82
4,175,604 A * 11/1979 Bonner ..... 383/5
4,384,670 A * 5/1983 Dicker ..... 229/69
4,479,588 A 10/1984 Davis et al.
4,566,129 A * 1/1986 McNamee ..... 383/5
4,573,634 A 3/1986 Kohler et al.
4,580,683 A * 4/1986 Gochenour ..... 383/205
4,614,297 A 9/1986 Davis et al.
4,653,113 A 3/1987 Taylor et al.
4,655,388 A * 4/1987 Fleming ..... 206/126
4,752,028 A 6/1988 Ogura
4,948,266 A 8/1990 Bencic
5,060,848 A 10/1991 Ewan
5,148,970 A 9/1992 Johnston
5,186,900 A 2/1993 Jensen et al.
5,265,794 A 11/1993 Johnston
5,290,104 A 3/1994 Sengewald
5,407,277 A 4/1995 Burke et al.
5,422,067 A 6/1995 Barney
5,503,328 A * 4/1996 Roccaforte et al. ..... 229/301
5,507,428 A 4/1996 Robinson, Jr. et al.
5,743,392 A 4/1998 Chapman
5,758,971 A 6/1998 Goglio et al.
5,935,847 A * 8/1999 Smith et al. ..... 435/297.5
5,957,583 A 9/1999 DeClements, Jr. et al.
6,048,008 A 4/2000 Shaw
6,085,903 A 7/2000 Jotcham et al.
6,126,000 A * 10/2000 Tung ..... 206/278
6,164,821 A 12/2000 Randall
6,296,388 B1 10/2001 Galomb et al.
6,446,861 B1 * 9/2002 Smith ..... 229/306
6,468,611 B1 * 10/2002 Haskin ..... 428/35.2
6,860,421 B2 3/2005 Lo Duca
6,886,980 B1 * 5/2005 Diplock ..... 383/10
7,267,261 B2 9/2007 Lo Duca
7,510,080 B2 3/2009 Smart et al.
7,614,542 B2 11/2009 Lo Duca
7,717,319 B2 5/2010 Adam
2001/0022318 A1 * 9/2001 Kaden et al. ..... 229/80
2002/0164088 A1 * 11/2002 Collins ..... 383/10
2003/0075593 A1 * 4/2003 Wood ..... 229/71
2004/0007867 A1 * 1/2004 Vaughan ..... 281/45
2005/0145683 A1 7/2005 Alagna et al.
2010/0252618 A1 10/2010 Adam et al.

* cited by examiner

86

EVIDENCE

Property/Evidence Envelope: Date: _____ Of _____

From Whom Obtained: _____

Where Obtained: _____

Defendant: _____

Alias: _____ Date of Birth: _____

Address: _____

Social Security No: _____ Birthplace: _____ Date of Offense: _____

Sex: _____ Race: _____ Height: _____ Weight: _____ Hair: _____ Eyes: _____

Co-Defendant No. 3: _____ Co-Defendant No. 3: _____

Complaint No.: _____ Dist. of Arrest: _____ Date/Time _____

Charge: _____ Dist & Arrest No.:: _____ Property Book: _____

Evidence: _____

_____

_____

_____

Where Obtained Exactly (i.e. location in residence, auto or on person): _____

_____

Seized by: _____ Assigned to: _____ Purchased by: _____

Amount Paid: _____ Collected by: _____ Assigned by: _____

PERSON RECOVERING EVIDENCE WILL PERSONALLY PLACE IN ENVELOPE AND SEAL

SEALED BY: Signature: _____ Date: _____ Time: _____

Print Name: _____ Assigned: _____

PICKED UP BY: _____ of the Narcotic Branch

Location Picked Up: _____ Date: _____ Time: _____

Witnesses: _____

Lab No.: _____

Received by: _____ Work Unit: _____ Date: _____ Time: _____

Received by: _____ Work Unit: _____ Date: _____ Time: _____

Received by: _____ Work Unit: _____ Date: _____ Time: _____

Received by: _____ Work Unit: _____ Date: _____ Time: _____

FIG - 8

TAMPER EVIDENT RETAINING DEVICE FOR USE WITH FLUID IMPREGNATED CLOTHING AND FABRICS

CROSS-REFERENCE TO RELATED APPLICATIONS

This patent application is a continuation-in-part of U.S. Ser. No. 12/023,792, filed Jan. 31, 2008, which in turn is a continuation in part of U.S. Ser. No. 10/891,347, filed Jul. 14, 2004 for a Foldable Blank in Use with a Bag Material and Securing and Retaining Articles of Evidence in Tamper Evident Fashion. This patent application is also a continuation-in-part of U.S. Ser. No. 11/294,827, filed Dec. 6, 2005, which in turn is a continuation in part of U.S. Ser. No. 10/891,347, filed Jul. 14, 2004, for a Foldable Blank in Use with a Bag Material and Securing and Retaining Articles of Evidence in Tamper Evident Fashion.

FIELD OF THE INVENTION

The present invention relates generally to an evidence retention device particularly useful for larger sized fluid impregnated articles. More specifically, the present invention teaches a tamper evident sealable assembly for holding, in secure and anti-degradation fashion, such fluid impregnated articles which are of evidentiary value in criminal matters.

The prior art is well documented with varying examples of storage and retention articles, such including bag-like structures, containers and the like. These articles are configured for a variety of different uses and applications.

U.S. Pat. No. 2,810,510, issued to Korn, teaches a bag closure exhibiting a base panel with a pair of adjacent panel portions foldable over each other and extending successively from the top edge of the base panel. The adjacent panel portions are adapted to receive therebetween the open top end walled portion of a flexible bag shaped container also including closed bottom and sides.

U.S. Pat. No. 5,758,971, to Goglio et al, teaches a container made of flexible (e.g. bellows type) material obtained by successive folding and welding of a sheet material provided with a handle system at its top edge, this further consisting of a cut made in a central part of the edge for finger insertion. Additional examples of bag closure devices, each of these including a top end secured handle or closure flap, includes Powell U.S. Pat. No. 1,955,310, Campbell U.S. Pat. No. 2,437,072 and Randall U.S. Pat. No. 6,164,821.

SUMMARY OF THE INVENTION

The present invention discloses a tamper-evident retaining device for use with articles of evidence, such as in particular larger fabric sized items including clothing, bed sheets and other items which may be impregnated with a fluid indicative of criminal activity, this further including such as blood, semen and the like. The present invention is also equally applicable to a tamper indicating evidence retaining mechanism for use with other types of articles, not limited to illegal narcotic plants (such as hemp) flora and the like.

According to one non-limiting application, the invention includes a base sheet having a top, sides and bottom, as well as a secondary sheet also having a top, sides and bottom and which is secured to the base sheet along their conjoining bottom edges. Each of the base sheet and secondary sheets are constructed of a breathable heavy duty paper stock material, such as known as a Kraft paper, and which provides the features of controlled drying and preservation of the fluid DNA and which is required in proper evidence handling applications.

A top closure, such as constructed of a durable paperboard or polymeric material, includes a central panel secured along the top of the base sheet. First and second side panels extend from opposite edges of the central panel and are pivotally opened in a first, evidence receiving, position.

First and second side flaps extending from the sides of the base sheet such that, upon pre-placement of the evidence article upon the base sheet and subsequent folding up of the secondary sheet to overlay the base sheet, the flaps are inwardly folded to secure, in tamper evident fashion, the sides of the secondary sheet to the sides of the base sheet. In concurrent fashion, the side panels are pivoted inwardly and in overlaying fashion against the central panel in a second position to secure, in likewise tamper evident fashion, the top of the base and secondary sheets.

Additional features include a plurality of evidence securing clips arranged at width extending spaced locations along the base sheet proximate the top, these providing for attachment of the evidence article and to prevent the same from shifting within the sealed mechanism once suspended or otherwise stored. Other features include tamper evident adhesive portions applied to each of the top closure and said the flaps, peel-away strips applied to each of the adhesive portions.

First portions are arranged along insides of each flap, and which matingly engage with second portions (these provided by such as hook and loop fasteners also known as Velcro® portions) positioned along an exposed surface of the folded up secondary sheet. The first portions are spaced inwardly from the peel away strips applied to each of the flaps, thereby permitting pre-engagement of the first and second mating portions and without interfering with subsequent removal of the peel-away strips.

Hand hold cutout portion are formed in a generally central location of the central panel. Each of the side panels further include a semi-cutout shaped portion defined in an outermost extending location such that, upon pivoting the side panels in overlaying fashion against the central panel, the subset shaped cutout portions align with the hand hold cutout portion. A bottom closure panel is secured to conjoining bottoms of the base and secondary sheets and, upon being aligned with the top closure panels, provides for ease of portability and/or suspended storage. An evidence entry form is also located upon a surface of the top closure.

BRIEF DESCRIPTION OF THE DRAWINGS

Reference will now be made to the attached drawings, when read in combination with the following detailed description, wherein like reference numerals refer to like parts throughout the several views, and in which:

FIG. 8 is an illustration of an evidence entry form secured to a suitable surface location of the tamper evident mechanism and providing a plurality of evidence entry fields pertaining to the retained item of evidence.

DETAILED DESCRIPTION OF THE PREFERRED EMBODIMENTS

Figure 1:
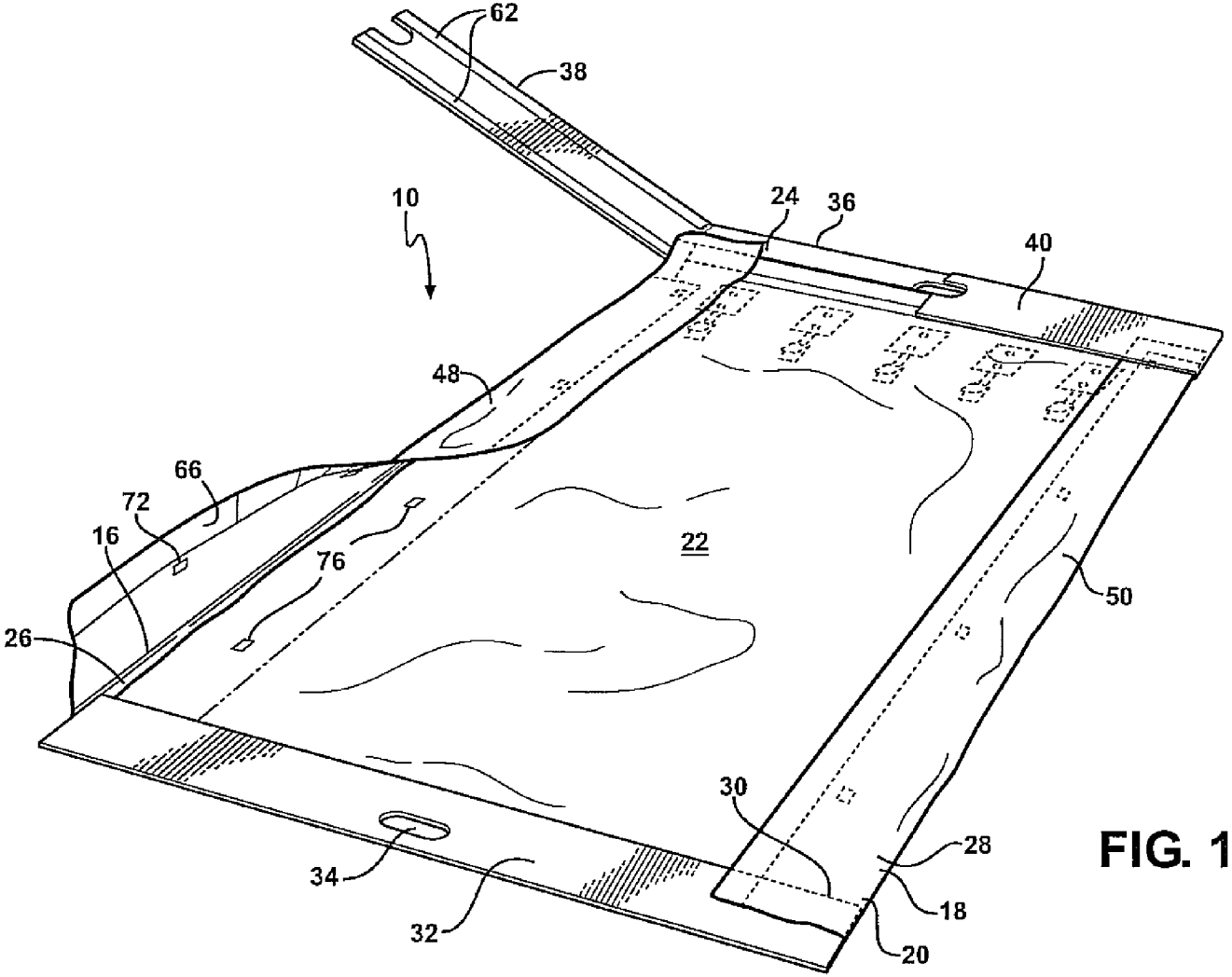
FIG. 1 is a perspective illustration of the tamper evidence retaining and drying mechanism according to the present invention and further illustrating the features of the top edge secured closure with fold over side panels as well as the overlapping and fold up sheet with side closures.

Referring now to FIG. 1, a perspective illustration is shown at 10 of the tamper evidence retaining and drying mechanism according to one non-limiting preferred embodiment of the present invention. As will be described in further detail, the present invention discloses a tamper-evident retaining device for use with articles of evidence, such as in particular larger fabric sized items including clothing, bed sheets and other items which may be impregnated with a fluid indicative of criminal activity, this further including such as blood, semen and the like. The present invention is also equally applicable to a tamper indicating evidence retaining mechanism for use with other types of articles, not limited to illegal narcotic plants (such as hemp) flora and the like.

Figure 2:
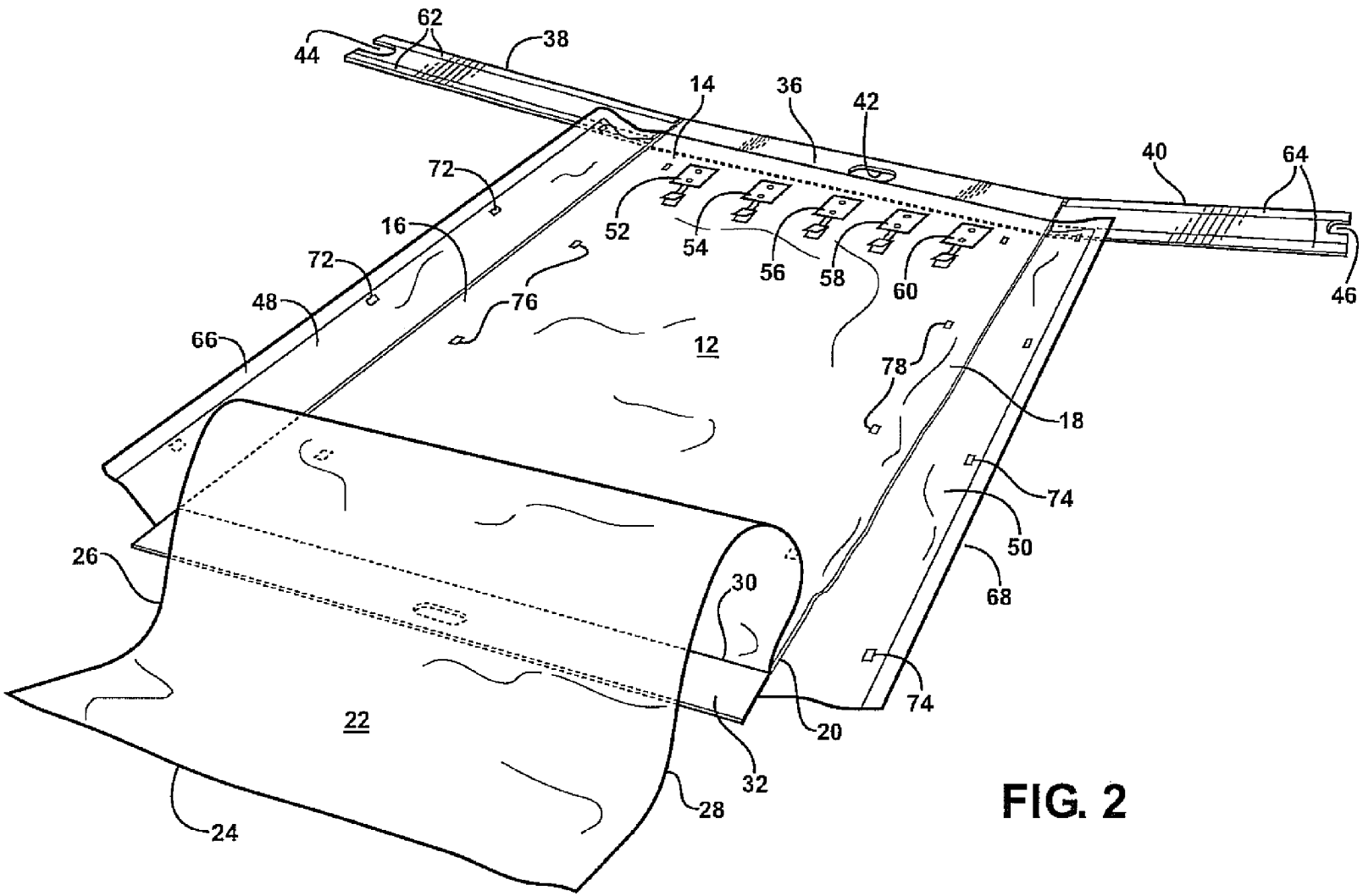
FIG. 2 is a succeeding view showing the mechanism in a fully opened position and in preparation with securing an article of evidence.

As further referenced in the succeeding illustration of FIG. 2, this showing the mechanism in a fully opened position and in preparation with securing an article of evidence, the drying mechanism includes a base sheet 12 having a top 14, sides 16 and 18 and bottom 20. A secondary sheet 22 is also provided and includes a top 24, sides 26 and 28 and bottom 30.

The base sheet 12 and secondary sheet 22 each exhibit a generally rectangular shape in a preferred embodiment, and are conjoined along connecting bottom edges 20 and 30, respectively as shown. Each of the base sheet 12 and secondary sheet 22 are constructed of a breathable heavy duty paper stock material, such as known as a Kraft paper, and which provides the features of controlled drying and preservation of the fluid DNA and which is required in proper evidence handling applications.

A bottom closure panel 32 is secured to conjoining bottom locations 30 and 20 of the base and secondary sheets, the panel 32 exhibiting a generally rectangular configuration which an enclosed inner perimeter defining edge 34 which establishes a generally oval shaped hand hold. Although not shown, it is also envisioned and understood that the base sheet 12 and secondary sheet 22 can be provided as a single extending sheet of similarly constructed material and which is creased or folded at a generally midpoint location corresponding to the conjoining edges 20 and 30 of the base 12 and secondary 22 sheets in the illustrated embodiment.

Figure 5:
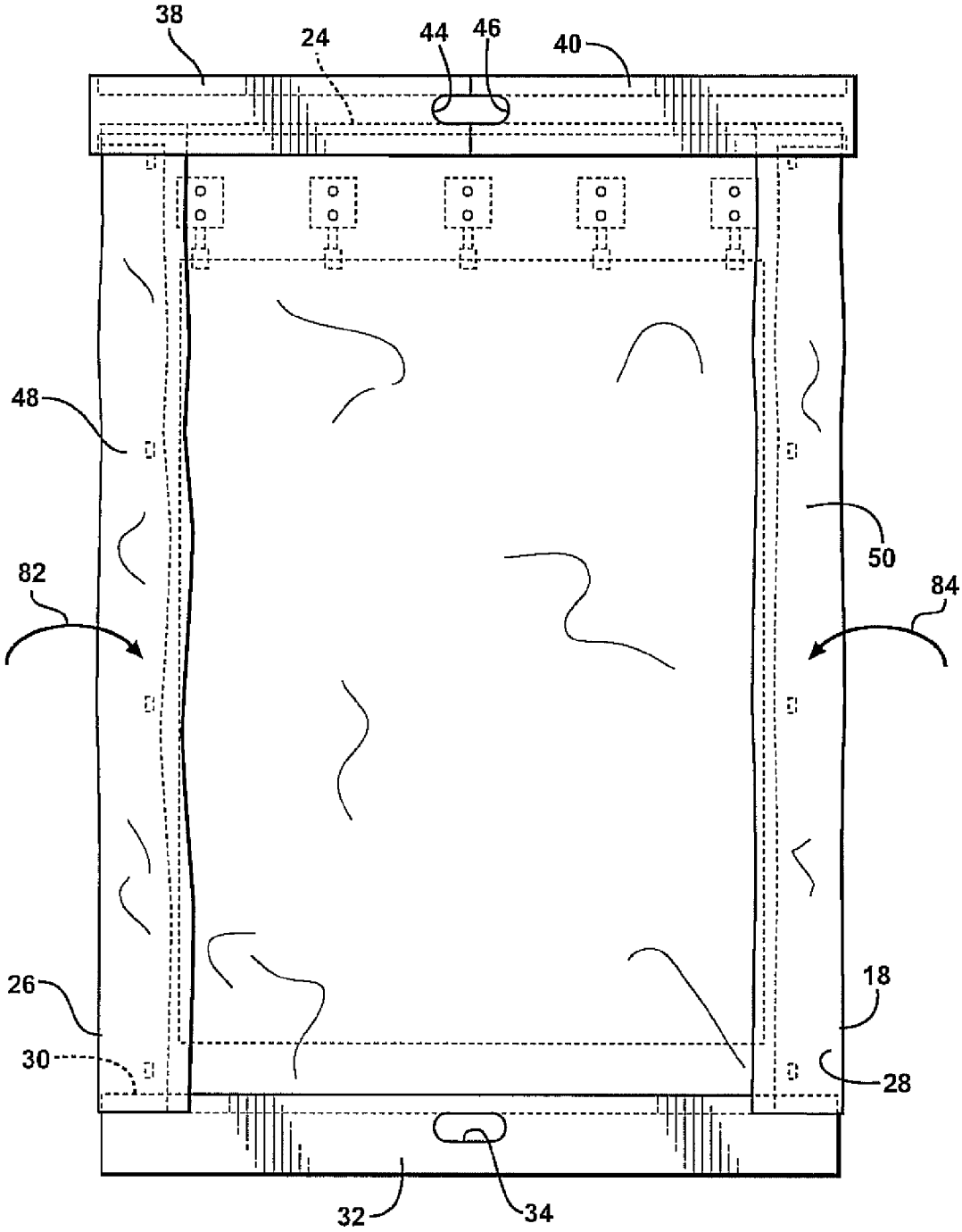
FIG. 5 is illustrates a succeeding view to that shown in FIG. 4 and showing the concurrent inwardly folding engagement of the top closure side panels, with tamper evident adhesive peel away portions, and separately the flaps extending from the sides of the base sheet in order to seal the top and sides of the aligning base sheet and fold over sheet.

A top closure is constructed of a durable paperboard or polymeric material, similar to the bottom closure panel 32. The top closure includes a central panel 36 secured along the top 14 of the base sheet. First and second side panels 38 and 40 extend from opposite edges of the central panel 36 and are pivotally opened in a first, evidence receiving, position. An enclosed inner perimeter defining edge 42 of similar configuration to that shown at 34 in relation to the bottom closure panel 34 establishes a mating hand hold cutout portion formed in a generally central location of the central panel 36. Each of the side panels 38 and 40 further include a semi-cutout shaped portion, see at 44 and 46, respectively, defined in outermost extending edge locations and such that, upon pivoting the side panels 38 and 40 in overlaying fashion against the central panel 36 (FIG. 5), the subset shaped cutout portions 44 and 46 align with the hand hold cutout portion created by mating perimeter defined edge 42.

First and second side flaps 48 and 50 extend from the sides 16 and 18 of the base sheet 12. The flaps 48 and 50 can extend any distance along the sides 16 and 18 of the base sheet 12, however, each preferably extends from an upper edge projecting underneath the lower half of the over-folding side panels 38 and 40 and to a lower edge which extends to the bottom of the closure panel 32 and is secured thereto along with securing to the sides of the folded-over sheet 22.

Figure 3:
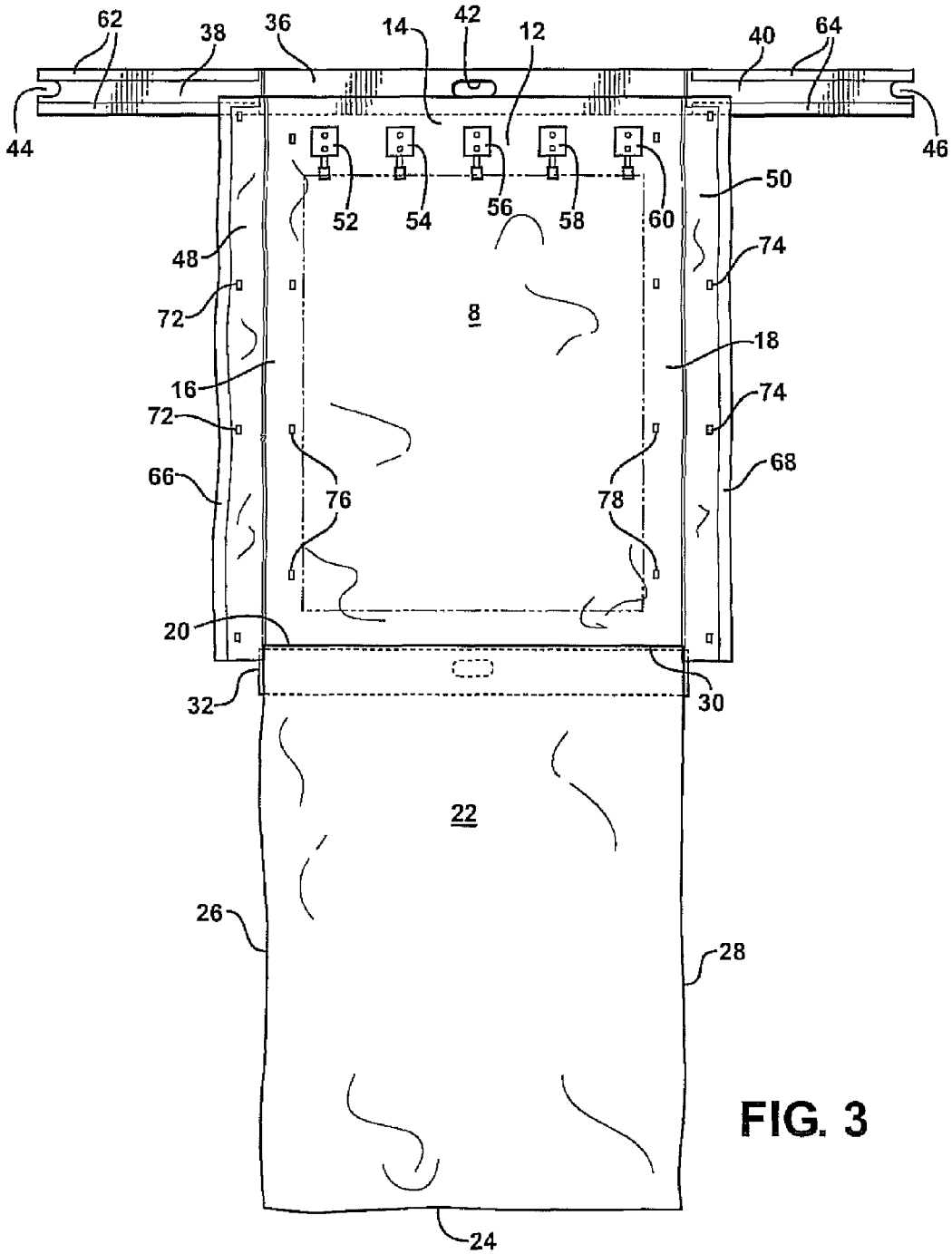
FIG. 3 is a further succeeding plan view illustrating the evidence article secured upon a revealed base sheet, and in particular to retaining clips arranged at width extending locations along an upper edge of the base sheet.

An article of evidence, see generally as represented in phantom at 8 in FIG. 3 can again include any type of fabric, sheet, carpet or other suitable article which is in particular impregnated with a fluid of evidentiary value which is desired to be maintained in a tamper evident proof fashion. The evidence article 8 is dimensioned so that it is supported upon the base sheet 12, in such a fashion so as not to interfere with the side sealing aspects of the fold over side flaps 48 and 50, as will be further described. A plurality of evidence securing clips, see as best shown by selected plurality of clips at 52, 54, 56, 58 and 60 in FIGS. 2 and 3, are arranged at width extending spaced locations along the base sheet 12 proximate its top 14, these providing for attaching the top of the evidence article 8, and to prevent the same from shifting within the sealed mechanism once suspended or otherwise stored.

Tamper evident adhesive portions are applied to each of the top closure, such as shown in pairs at 62 and 64 in reference to the pivoting side panels 38 and 40, as well as further at 66 and 68 in extending fashion along inner facing surfaces of the side flaps 48 and 50. Peel-away strips are applied over each of the adhesive portions 62, 64, 66 and 68 (see as further shown in FIG. 6 with reference to peel away strip 70 revealing adhesive underside 68 associated with the inner facing surface of the selected first flap 48.

Figure 6:
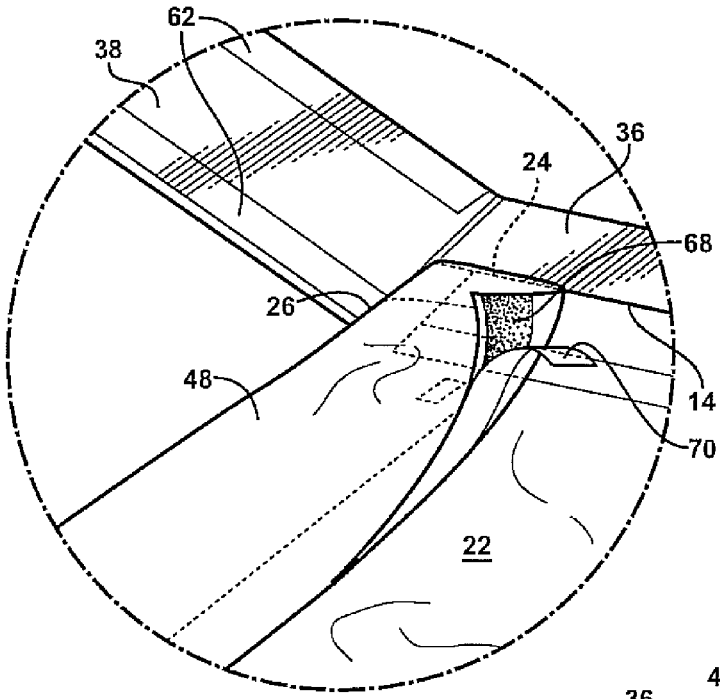
FIG. 6 is an enlarged partial view of a selected peel away strip associated with an inwardly extending underside edge of a selected side flap and arranged an inwardly spaced distance from locating hook and loop portions associated with the inside of the flaps and the exterior facing surface of the fold up sheets, removal of the peel away strip revealing a tamper evident adhesive for securing the flaps over the exterior facing edge surfaces of the fold up sheets.

Individual pluralities of first portions, of which four are illustrated at 72 as well as 74, are arranged along in spaced apart fashion along inside surfaces of each flap 48 and 50. The first portions 72 and 74 matingly engage with second portions 76 and 78 (these collectively defined by such as hook and loop fasteners also known as Velcro® portions) and which are positioned along an exposed surface of the folded up secondary sheet 22 proximate its extending sides 26 and 28. As shown, the first of the hook and loop portions (72 and 74) are spaced inwardly from the adhesive portions 66 and 68 with peel away strips (see again 70 in FIG. 6) applied to each of the flaps 48 and 50, thereby permitting pre-engagement of the first (hook) and second (loop) mating portions (referring again to FIG. 5), and without interfering with subsequent removal of the peel-away strips (FIG. 6).

Figure 4:
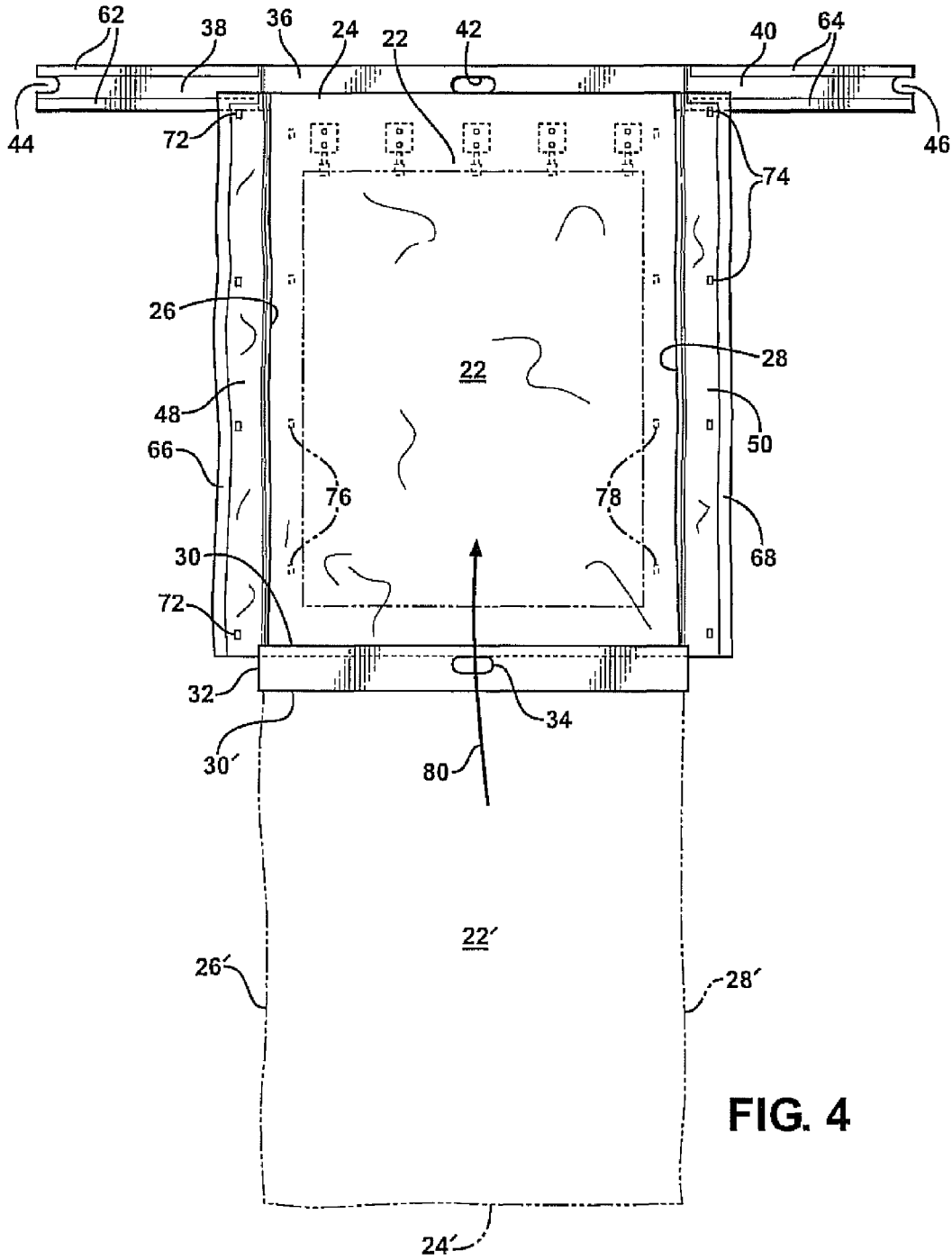
FIG. 4 is illustrates a succeeding view to that shown in FIG. 3 and by which the fold up sheet is positioned in generally aligning fashion with the base sheet and in order to sandwich therebetween the evidence article.

In this fashion, and upon the evidence article 8 being secured upon the base sheet 12 (FIG. 3), and subsequent folding up of the secondary sheet 22 to overlay the base sheet 12 (see arrow 80 in FIG. 4), the flaps 48 and 50 are inwardly folded (see as illustrated by directional arrows 82 and 84 in FIG. 5) to secure, in tamper evident fashion, the sides 26 and 28 of the secondary sheet 22 to the sides 16 and 18 of the base sheet 12.

Following removal of the peel away strips associated with the side flap adhesive portions 66 and 68, the outermost positioned adhesive portions are secured in tamper-evident indicating fashion (again FIG. 5) over the exposed facing edges of the folded up secondary sheet 22. In concurrent fashion, the peel away strips associated with the pivoting side panels 38 and 40 of the top closure are removed, following which the panels 38 and 40 are pivoted inwardly and in overlaying fashion against the central panel 36 (see again FIG. 5) in a second position to secure, in likewise tamper evident fashion, the tops 14 and 24 of the base 12 and secondary 22 sheets.

Figure 7:
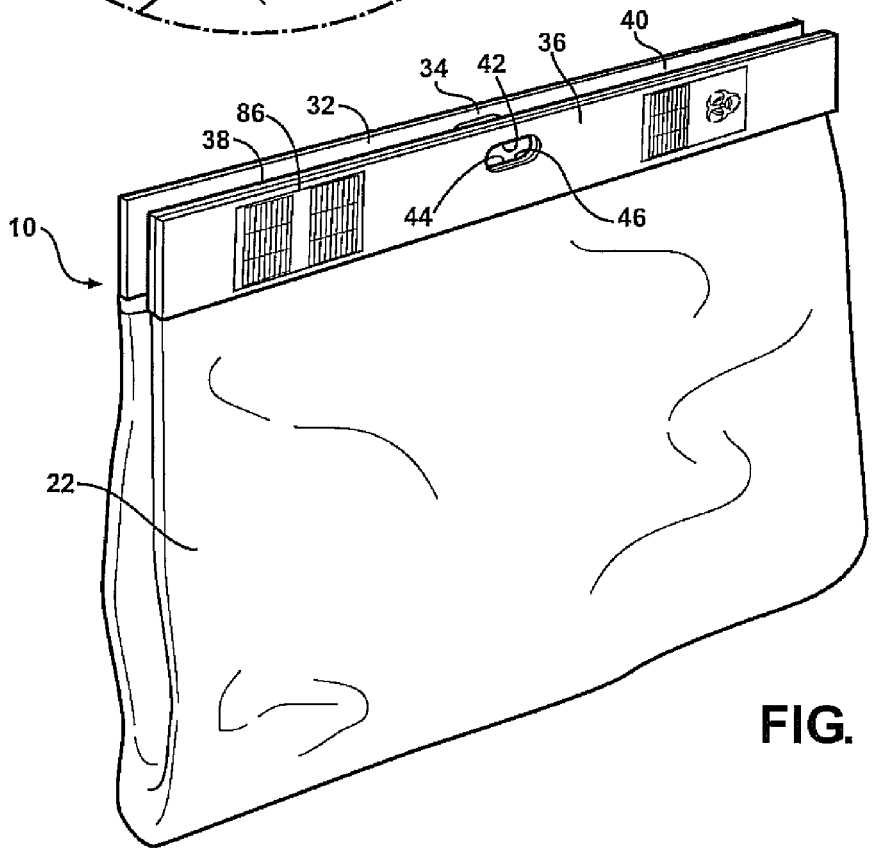
FIG. 7 is a perspective illustration of a fully tamper evident sealed mechanism, and in which a similarly configured and fixed panel associated with a bottom joining edge of the base and fold up sheets is aligned with the top closure panel for ease of portability and/or suspended storage.

Upon being completely sealed, the bottom closure panel 32 is folded in order to align with the sealed panels 36, 38 and 40 of the top closure, the aligning hand hold locations 34 and 42 (as well as overlapping semi-hand hold portions 46 & 48 associated with the pivoting side panels 38 and 40) providing for ease of portability and/or suspended storage as further shown in FIG. 7. An evidence entry form is shown at 86 in each of FIG. 7 adhesively applied over an exposed rear surface of the central panel 36 as well as in enlarged form in FIG. 8.

As further referenced in FIG. 8, the evidence form 86 provides a listing of entry fields including those for: Property/Evidence Envelope: Date, From Who Obtained, Where Obtained, Defendant, Alias, D.O.B., Address, Social Security Number, Birthplace, Date of Offense, Sex, Race, Height, Weight, Hair, Eyes, Co-Defendant 1, Co-Defendant 2, Complaint No., District of Arrest, Date/Time, Charge, District of Arrest No., Property Book, description of Evidence, Where Obtained, Seized By, Assigned To, Purchased By, Amount Paid, Collected By, and Assigned by. Additional fields relevant to the person recovering and sealing evidence include those for: Sealed By: Signature, Date, Time, Print Name, Assigned, Picket Up By, Location Picked Up, Date, Time, Witness, Lab No., Received By, Work Unit, Date and Time.

The purpose of the various data entry fields is to provide a written record of all of the particulars relating to the original evidence collection and retention, such as associated with a criminal event. That said, situations often exist where retrieval of the evidence is required, such as during an ongoing criminal legal investigation or court action, and in which the access to evidence during discovery or at trial is needed, such as in order to confirm or refute a suspect's alibi and/or to substantiate an issue of fact supporting a legal position taken by the prosecution in seeking to establish a charge against the suspect being charged.

Having described my invention, other additional preferred embodiments will become apparent to those skilled in the art to which it pertains, and without deviating from the scope of the appended claims:

I claim:

1. A tamper-evident retaining device adapted for use with fabric articles of evidence which may contain fluid indicative of criminal activity, said device comprising:

a base sheet having a top, sides and bottom;

a plurality of evidence securing clips arranged at width extending spaced locations along said base sheet proximate said top and which are adapted to engaged edge locations associated with the fabric article;

a secondary sheet having a top, sides and bottom, said bottom of said secondary sheet secured to said bottom of said base sheet;

a top closure including a central panel secured along said top of said base sheet, first and second side panels extending from opposite edges of said central panel and being pivotally opened in a first position;

first and second side flaps extending from said sides of said base sheet such that, upon pre-placement of the evidence article upon said base sheet and subsequent folding up of said secondary sheet to overlay said base sheet, said flaps are inwardly folded to secure, in tamper evident fashion, said sides of said secondary sheet to said sides of said base sheet;

adhesive portions applied to each of said top closure and said side flaps, peel-away strips applied over each of said adhesive portions and upon said flaps;

first portions arranged along insides of each flap which matingly engage with second portions positioned along an exposed surface of said folded up secondary sheet, said first portions being spaced inwardly from outer edges of said flaps along which said adhesive portions and peel-away strips extend, thereby permitting pre-engagement of said first and second portions and without interfering with subsequent removal of said peel-away strips; and said side panels being pivoted inwardly and in overlaying fashion against said central panel in a second position to secure, in tamper evident fashion, said top of said base and secondary sheets.

2. The device as described in claim 1, further comprising a hand hold cutout portion formed in a generally central location of said central panel.

3. The device as described in claim 2, each of said side panels further comprising a semi-cutout shaped portion defined in an outermost extending location such that, upon pivoting said side panels in overlaying fashion against said central panel, said subset shaped cutout portions align with said hand hold cutout portion.

4. The device as described in claim 1, further comprising a bottom closure panel secured to conjoining bottoms of said base and secondary sheets and, upon being aligned with said top closure panels provides for ease of portability and/or suspended storage.

5. The device as described in claim 1, said top closure having a specified shape and size and further comprising at least one of a paperboard or a plasticized material.

6. The device as described in claim 1, further comprising an evidence entry form located upon a surface of said top closure.

7. The device as described in claim 1, each of said base sheet and secondary sheet having a specified shape and size and further comprising a breathable heavy duty paper stock material.

8. The device as described in claim 1, said first and second portions further comprise releasable engaging hook and loop fasteners.

9. A drying mechanism for holding a fluid impregnated fabric article of evidence in secure and tamper evident fashion, comprising:

an elongated sheet having a top, sides and bottom;

a plurality of evidence securing clips arranged at width extending spaced locations along said sheet proximate said top and which are adapted to engaged edge locations associated with the fabric article;

a top closure including a central panel secured along said top of said sheet, first and second side panels extending from opposite edges of said central panel and being pivotally opened in a first position;

a bottom closure panel secured to said bottom of said sheet;

first and second side flaps extending from and along an upper half of said sheet from said top, first and second pluralities of hook and loop fastener portions being provided respectively on inside facing locations of said side flaps and opposing aligning edge proximate locations on said sheet;

adhesive portions applied along said top closure as well as along said side flaps at outer proximate edges and which are covered by peel away strips such that, upon preplacement of the evidence article upon said upper half and subsequently folding up of a lower half of said sheet to overlay said upper half and so that said bottom panel aligns with said top closure panel, said flaps are inwardly folded in a first pre-engagement step for aligning and securing together said hook and loop fasteners and subsequently, in a second step, for securing, in tamper evident fashion, said adhesive portions along exposed sides of said lower half of said elongated sheet; and said side panels being pivoted inwardly and in overlaying fashion against said central panel in a second position to additionally secure, in tamper evident fashion, said bottom of said sheet.

10. The device as described in claim 9, further comprising a plurality of evidence securing clips arranged at width extending spaced locations along said sheet proximate said top.

11. The device as described in claim 9, further comprising a hand hold cutout portion formed in a generally central location of said central panel, each of said side panels further comprising a semi-cutout shaped portion defined in an outermost extending location such that, upon pivoting said side panels in overlaying fashion against said central panel, said subset shaped cutout portions align with said hand hold cutout portion.

12. The device as described in claim 9, said top closure having a specified shape and size and further comprising at least one of a paperboard or a plasticized material, an evidence entry form located upon a surface of said top closure.

13. The device as described in claim 9, said sheet having a specified shape and size and further comprising a breathable heavy duty paper stock material.

14. The device as described in claim 9, said first and second portions further comprise releasable engaging hook and loop fasteners.

* * * * *